US011217891B2

(12) United States Patent
Monma et al.

(10) Patent No.: US 11,217,891 B2
(45) Date of Patent: Jan. 4, 2022

(54) ANTENNA DEVICE

(71) Applicants: Daiki Monma, Tama (JP); Kozo Shimizu, Tama (JP); Takahiro Oshima, Tama (JP); Kazunari Saito, Tama (JP)

(72) Inventors: Daiki Monma, Tama (JP); Kozo Shimizu, Tama (JP); Takahiro Oshima, Tama (JP); Kazunari Saito, Tama (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 59 days.

(21) Appl. No.: 16/774,549

(22) Filed: Jan. 28, 2020

(65) Prior Publication Data

US 2020/0251824 A1 Aug. 6, 2020

(30) Foreign Application Priority Data

Jan. 31, 2019 (JP) ..... JP2019-015782

(51) Int. Cl.

| | |
|---|---|
| ***H01Q 1/38*** | (2006.01) |
| ***H01Q 5/314*** | (2015.01) |
| ***H01Q 9/04*** | (2006.01) |
| ***H01Q 21/06*** | (2006.01) |

(52) U.S. Cl.

CPC ..... *H01Q 5/314* (2015.01); *H01Q 9/0414* (2013.01); *H01Q 21/065* (2013.01)

(58) Field of Classification Search

CPC ..... H01Q 5/314; H01Q 9/0414; H01Q 21/065

See application file for complete search history.

(56) References Cited

U.S. PATENT DOCUMENTS

| | | | | |
|---|---|---|---|---|
| 7,277,056 | B1 | 10/2007 | Thiam et al. | |
| 7,528,780 | B2 | 5/2009 | Thiam et al. | |
| 2008/0068270 | A1 | 3/2008 | Thiam et al. | |
| 2014/0077865 | A1* | 3/2014 | Ashjaee | H03H 11/1239 327/513 |
| 2020/0136257 | A1* | 4/2020 | Hwang | H01Q 1/521 |

FOREIGN PATENT DOCUMENTS

| | | | |
|---|---|---|---|
| JP | 2009506730 | A | 2/2009 |

* cited by examiner

*Primary Examiner* — Dieu Hien T Duong

(74) *Attorney, Agent, or Firm* — Holtz, Holtz & Volek PC

(57) ABSTRACT

An antenna device includes an antenna unit that receives radio waves of a plurality of first frequency bands and outputs received signals, and a first band pass filter that transmits, out of the received signals that are output, received signals of at least two second frequency bands out of the first frequency bands.

3 Claims, 5 Drawing Sheets

ANTENNA DEVICE

BACKGROUND

Technological Field

The present invention relates to an antenna device.

Description of the Related Art

Conventionally, there is a navigation satellite system that measures a position of a moving object such as a motor vehicle. In the navigation satellite system, a receiver provided in the moving object receives a signal transmitted from a satellite of the navigation satellite system with an antenna device, and uses the received signal to measure the position of the moving object itself. GPS (Global Positioning System) is known as a communication standard of the navigation satellite system. GPS is a standard in the United States, and the frequency bands of carrier waves include an L1 band (center frequency: 1575.42 [MHz]), L2 band (center frequency: 1227.60 [MHz]), L3 band, L4 band, and L5 band (center frequency: 1176.45: [MHz]), depending on its usage and the like.

Furthermore, GLONASS (Global Navigation Satellite System) is known as a communication standard of a Russian navigation satellite system, and the frequency bands of carrier waves include an L1 band (center frequency: 1598.0625 [MHz] to 1605.375 [MHz]), L2 band (center frequency: 1242.9375 [MHz] to 1248.625 [MHz]), and the like. QZSS (Quasi-Zenith Satellite System, Michibiki) is known as a communication standard of a Japanese navigation satellite system, and uses an L1 band, L2 band, L5 band, L6 band (LEX (L-band EXperiment), center frequency: 1278.75 [MHz]), and the like. Thus, there are known various standards of navigation satellite system using different frequencies.

There is known an antenna device that receives signals in the L1 band (for code positioning) and the L2 band (for carrier wave positioning) of GPS in order to improve the positioning accuracy. Such an antenna device for two frequency bands has a dielectric substrate with two loop antenna elements for the L1 band and the L2 band thereon.

Another antenna device for two frequency bands is known to be a stacked patch antenna provided with a first single-feed patch antenna having a feed pin and a dielectric layer that deals with a frequency band of SDARS (Satellite Digital Audio Radio Service), and a second single-feed patch antenna having a feed pin and a dielectric layer that deals with a frequency band of GPS (see Japanese Patent Application Publication No. 2009-506730).

However, in the above-described antenna device having the two loop antenna elements and the above-described stacked patch antenna, a good axial ratio can be obtained only from limited frequency ranges, for example, from the L1 band of GPS and the L2 band of GPS, but not from the L1 band of GPS and the L1 band of GLONASS or from the L2 band of GPS and the L2 band of GLONASS. Generally, a two-feed patch antenna can deal with larger bandwidths, however, an active antenna requires one block of an LNA (Low Noise Amplifier) for each frequency band.

SUMMARY

An object of the present invention is to simplify a circuit configuration that deals with a plurality of frequency bands.

In order to solve the above problems, according to an aspect of the present invention, there is provided an antenna device including:

an antenna unit that receives radio waves of a plurality of first frequency bands and outputs received signals; and a first band pass filter that transmits, out of the received signals that are output, received signals of at least two second frequency bands out of the first frequency bands.

DESCRIPTION OF THE PREFERRED EMBODIMENTS

Hereinafter, embodiments of the present invention will be described in detail with reference to the attached drawings. However, the scope of the invention is not limited to the illustrated examples.

Figure 1:
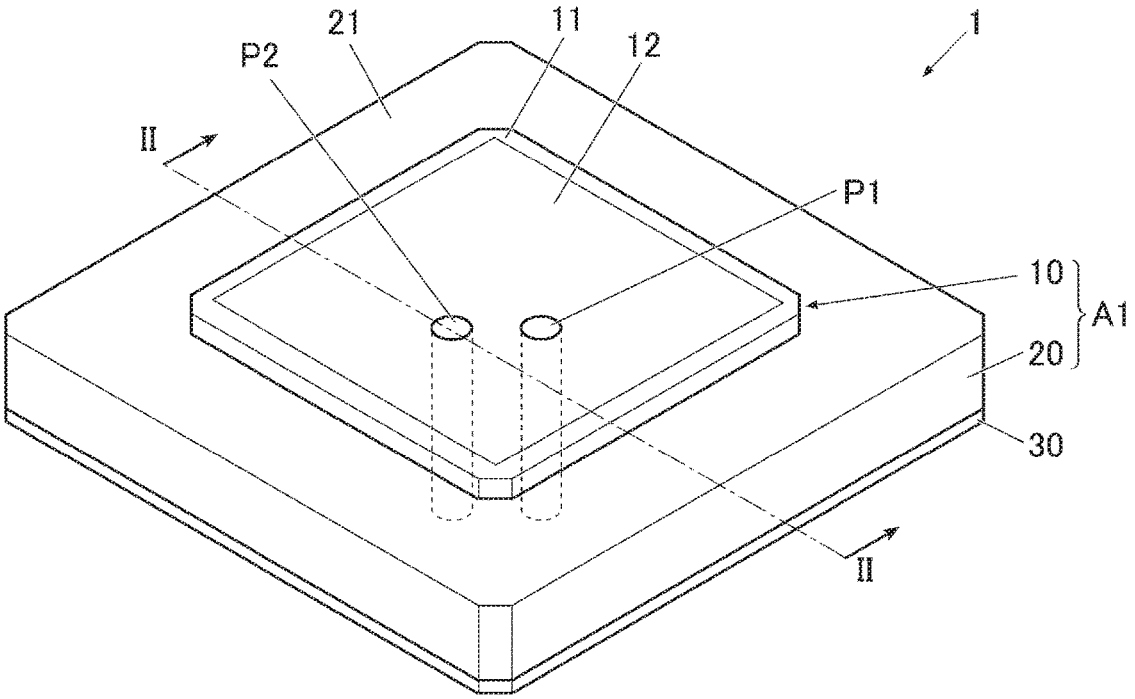
FIG. 1 is a perspective view of a first antenna device according to an embodiment of the present invention.
Figure 2:
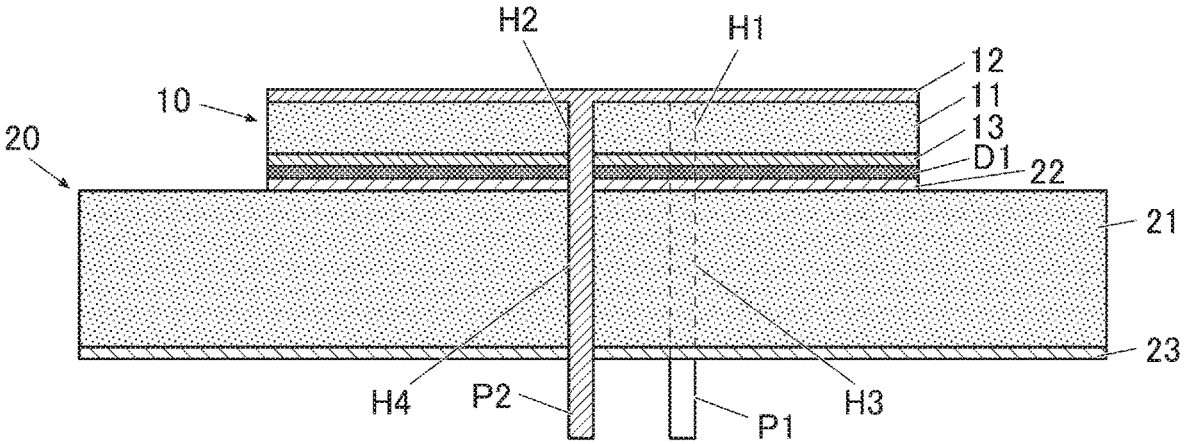
FIG. 2 is a schematic cross-sectional view of a first antenna element and a second antenna element along a line II-II in FIG. 1.
Figure 3:
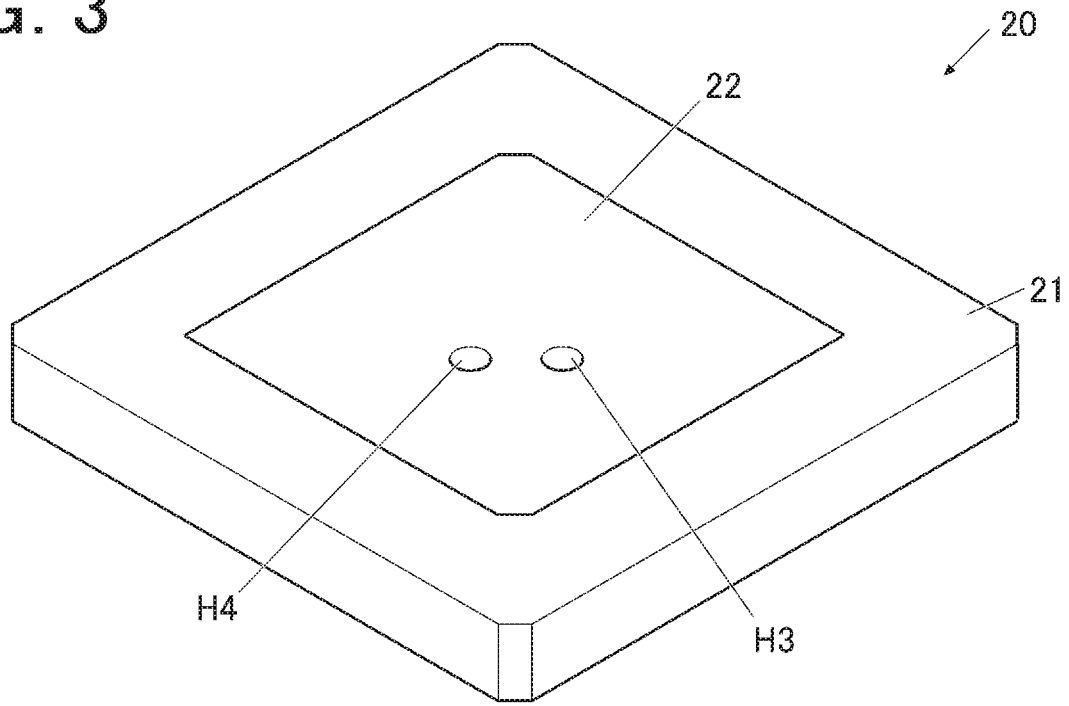
FIG. 3 is a perspective view of the second antenna element.

An embodiment according to the present invention will be described with reference to FIG. 1 to FIG. 5. First, the overall device configuration of the antenna device 1 according to the present embodiment will be described with reference to FIG. 1 to FIG. 3. FIG. 1 is a perspective view of the antenna device 1 according to the present embodiment. FIG. 2 is a schematic cross-sectional view of antenna elements 10, 20 along the line II-II in FIG. 1. FIG. 3 is a perspective view of the antenna element 20.

The antenna device 1 of the present embodiment is a two-feed patch antenna used in a navigation satellite system such as GNSS (Global Navigation Satellite System) and receives a circularly polarized satellite signal as a radio wave from a satellite of GNSS. The antenna device 1 is installed on a motor vehicle or the like as a moving object.

The antenna device 1 is a patch antenna that deals with a plurality of frequency bands of one or more communication standards for GNSS, the navigation satellite systems. The antenna device 1 deals with a plurality of frequency bands of GNSS, for example, three frequency bands including the L1 band of GPS, the L2 band of GPS, and the L5 band of GPS or the L6 band of QZSS.

As shown in FIG. 1, the antenna device 1 includes an antenna unit A1, a substrate 30, and feed pins P1 and P2. As shown in FIG. 1 and FIG. 2, the antenna unit A1 has antenna elements 10, 20 and a double-sided tape D1. In the antenna device 1, the substrate 30, the antenna element 20, the double-sided tape D1, and the antenna element 10 are stacked in this order from bottom to top. The bottom surface of the antenna element 10 (ground electrode 13 described later) and the top surface of the antenna element 20 (emitting electrode 22 described later) are adhered via the double-sided tape D1.

As shown in FIG. 1 and FIG. 2, the antenna element 10 has a base 11, an emitting electrode 12, and a ground electrode 13. The base 11 is a dielectric base that has a substantially square top surface. The base 11 is formed from, for example, a dielectric material such as ceramics. However, the base 11 is not limited to a configuration made of a dielectric, but may be configured with a composite material of a dielectric and a magnetic substance. This composite material includes a dielectric base such as polypropylene mixed with particles of a magnetic substance such as iron or hexagonal ferrite.

There are two holes H1, H2 penetrating the base 11, the emitting electrode 12, and the ground electrode 13 from the top surface to the bottom surface. The feed pin P1 is inserted into the hole H1. The feed pin P2 is inserted into the hole H2. The emitting electrode 12 is a conducting portion made of a metal paste such as silver or copper foil and is provided on the top surface of the base 11 as a surface for emitting an antenna signal (a radio wave receiving surface from a satellite). The emitting electrode 12 has, for example, a substantially square shape with no perturbation element (cut). The emitting electrode 12 may have a perturbation element. The feed pins P1, P2 are soldered and electrically connected to the emitting electrode 12. The ground electrode 13 is a conducting portion made of copper foil or the like and is provided on the bottom surface of the base 11. The ground electrode 13 is not electrically connected to the feed pin P1 or P2.

The dimensions and shapes of the base 11, the emitting electrode 12, and the ground electrode 13 are set such that the satellite signal of the L1 band of GPS can be received.

As shown in FIG. 2 and FIG. 3, the antenna element 20 has a base 21, the emitting electrode 22, and a ground electrode 23. The base 21 is a dielectric base that has a substantially square top surface. The base 21 is formed from, for example, a dielectric material such as ceramics. The base may be configured with a composite material of a dielectric and a magnetic substance. There are two holes H3, H4 penetrating the base 21 from the top surface to the bottom surface. The positions of the holes H3 and H4 correspond to the positions of the holes H1 and H2. The feed pin P1 is inserted into the hole H3. The feed pin P2 is inserted into the hole H4. The diameter of the hole H3 is larger than the diameter of the cross section of the feed pin P1, and the diameter of the hole H4 is larger than the diameter of the cross section of the feed pin P2.

The emitting electrode 22 is a conducting portion made of a metal paste such as silver or copper foil and is provided on the top surface of the base 21 as a surface for emitting (receiving) an antenna signal. The emitting electrode 22 has, for example, a substantially square shape with two perturbation elements (cuts) each on opposite corners and paired with each other. The emitting electrode 22 may have no perturbation element (cut). The ground electrode 23 is a conductor made of copper foil or the like and is provided on the bottom surface of the base 21. The diameter of the hole H3 is larger than the diameter of the cross section of the feed pin P1, and the diameter of the hole H4 is larger than the diameter of the cross section of the feed pin P2, such that the emitting electrode 22 or the ground electrode 23 is not electrically connected to the feed pin P1 or P2.

The dimensions and shapes of the base 21, the emitting electrode 22, and the ground electrode 23 are set so as to receive satellite signals of the L2 band of GPS and one of the L5 band of GPS and the L6 band (center frequency: 1278.75 [MHz]) of QZSS (Quasi-Zenith Satellite System, Michibiki). The L2 band of GPS, the L5 band of GPS, and the L6 band of QZSS have lower frequencies than the L1 band of GPS. Therefore, for example, the dimensions of the base 21 and the emitting electrode 22 are set larger than the dimensions of the base 11 and the emitting electrode 12.

Furthermore, the size of the base 11 (antenna element 10), base 21 (antenna element 20) can be reduced as a result of a wavelength shortening effect in response to increase of permittivity of the dielectrics as the base 11, base 21. Furthermore, when the base 11, 21 is a composite material, the size of the base 11 (antenna element 10), base 21 (antenna element 20) can be reduced as a result of a wavelength shortening effect caused by increase of permittivity and permeability of the base 11, 21. The dimension and shape of the emitting electrode 22 of the present invention correspond to the dimension and shape of the base 11 (ground electrode 13) in FIG. 1 to FIG. 3, but are not limited thereto. The dimension and shape of the emitting electrode 22 are appropriately set depending on the permittivity (and permeability) of the base 21 and the like.

Furthermore, the bandwidth of the receivable frequency band can be adjusted when the thickness (dimension in the stacking direction) of the base 11, 21 is changed. For example, when the thickness of the base 11, 21 is increased, the receivable bandwidth is expanded, and the absolute value of the gain can be increased because the base 11, 21 becomes large. When the thickness of the base 11, 21 is reduced, the receivable bandwidth can be narrowed (a predetermined bandwidth is not used), and the absolute value of the gain can be reduced because the base 11, the base 21 becomes small.

As shown in FIG. 1, the substrate 30 is a printed circuit board (PCB), and is provided on the ground electrode 23 side of the base 21. The substrate 30 has a substrate body 301. The substrate body 301 is an insulating substrate such as FR4 (Flame Retardant Type 4), in which glass fibers are impregnated with epoxy resin. On one plane of the substrate body 301 where a circuit pattern is formed, there are mounted a circuit element that amplifies, filters, and attenuates the satellite signals received by the antenna elements 10, 20. On the entire surface of the plane opposite to the circuit pattern (on the ground electrode 23 side) of the main body 301, there is patterned a ground electrode (not shown) made of a metal conductor such as silver foil formed. The planes of the substrate body 301 each have, for example, a substantially square shape corresponding to the antenna element 20. The circuit configuration of the substrate 30 will be described later.

The antenna device 1 is connected to one end of a coaxial cable 50 (FIG. 5) and, with a shield case, a cushion sheet, a top cover, a bracket, and the like (all not shown) attached thereto, installed on a moving object (on a dashboard, shark fin, ceiling of vehicle, or the like in a motor vehicle). A receiver (not shown) of GNSS is connected to the other end of the coaxial cable 50.

Figure 4:
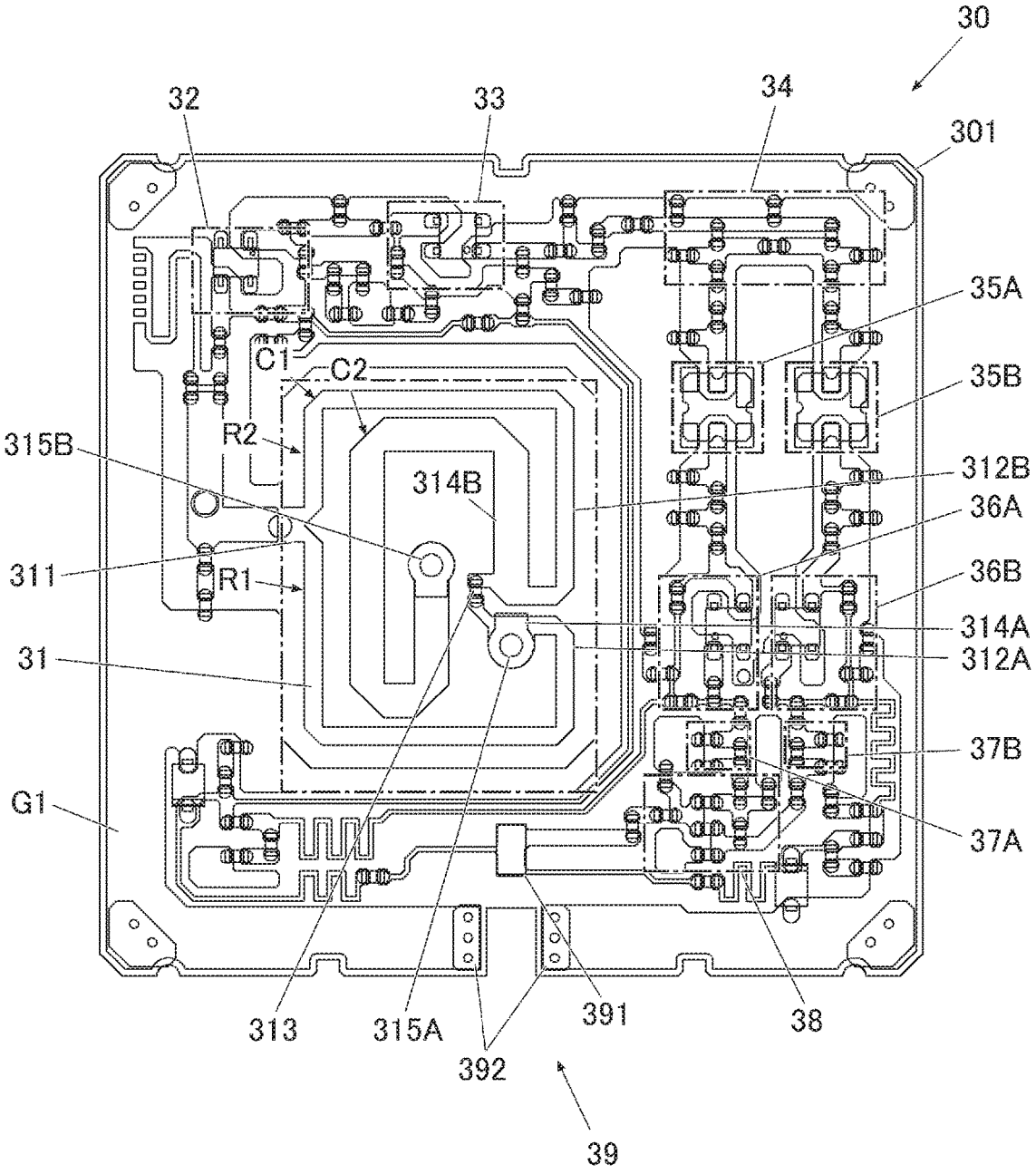
FIG. 4 is a plan view of a substrate.
Figure 5:
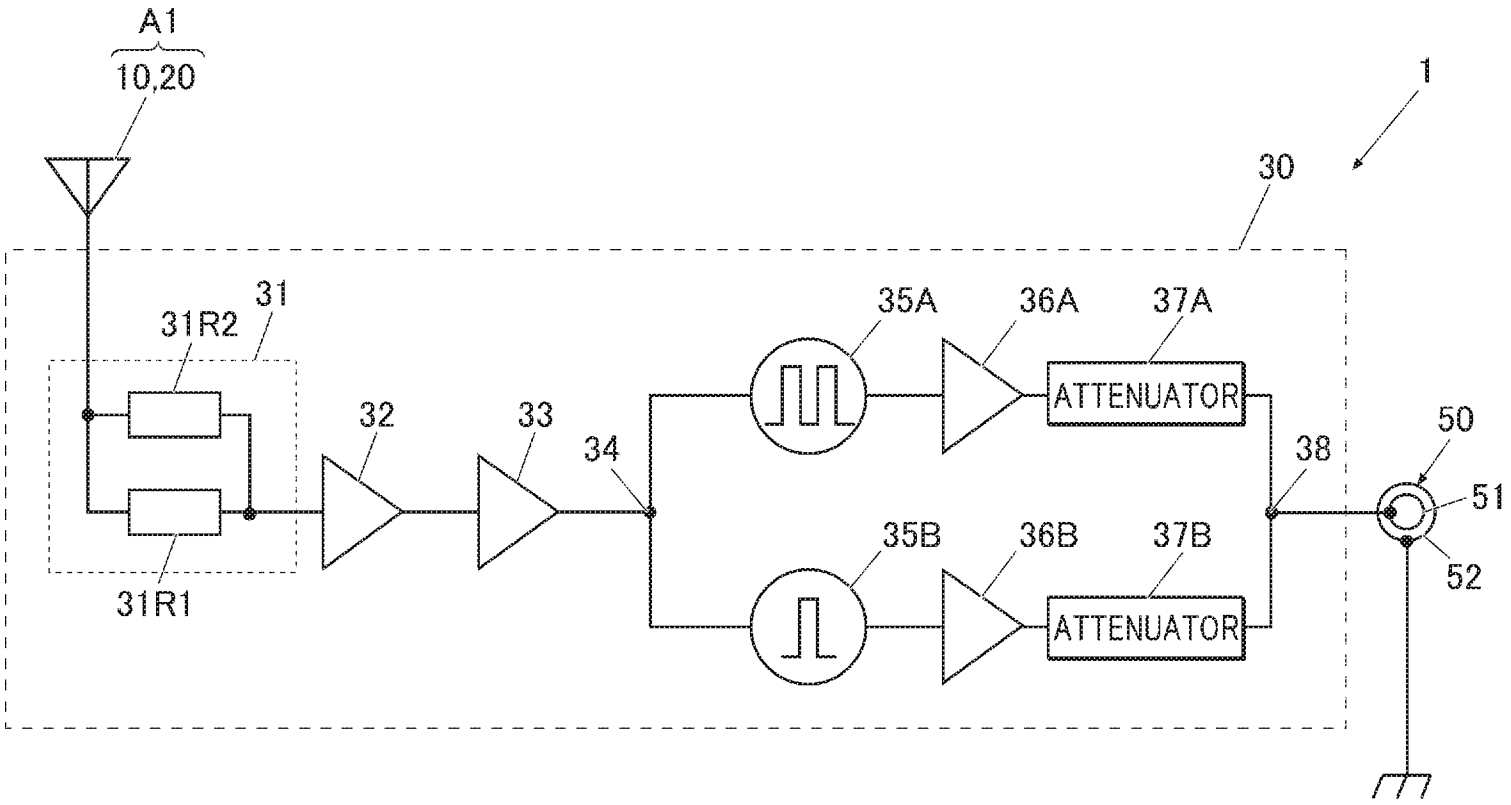
FIG. 5 is a circuit diagram of the first antenna device.

Next, a circuit configuration of the substrate 30 will be described with reference to FIG. 4 and FIG. 5. FIG. 4 is a plan view of the substrate 30. FIG. 5 is a circuit diagram of the antenna device 1.

As shown in FIG. 4, the surface of the substrate 30 (bottom surface of the antenna device 1) includes a Wilkinson divider (Wilkinson coupler) 31, amplifiers 32, 33, a Wilkinson divider 34, BPFs (Band Pass Filters) 35A, 35B, amplifiers 36A, 36B, attenuators 37A, 37B, a Wilkinson divider (Wilkinson coupler) 38, and a coaxial cable connector 39.

FIG. 5 shows a circuit configuration of the antenna elements 10, 20 and the substrate 30 (and the coaxial cable 50). As shown in FIG. 5, the antenna elements 10, 20 (the feed pins P1, P2 penetrating the antenna elements 10, 20) are connected to the Wilkinson divider 31, the amplifier 32, and the amplifier 33 in series in this order. The Wilkinson divider 34 divides the circuit into two paths. In one of the paths, the BPF 35A, the amplifier 36A, and the attenuator 37A are connected in series in this order. In the other path, the BPF 35B, the amplifier 36B, and the attenuator 37B are connected in series in this order. The output ends of the attenuators 37A, 37B are coupled via a Wilkinson divider 38 to form one path and connected to an inner conductor 51 of the coaxial cable 50. An outer conductor 52 of the coaxial cable 50 is grounded.

The antenna element 10 is electrically connected to the feed pins P1, P2, and functions as a contact-feeding antenna that receives a radio wave of the L1 band of GPS as a GPS signal. The antenna element 20 is not electrically connected to the feed pins P1, P2, and functions as a non-contact-feeding antenna that receives radio waves of the L2 band of GPS and one of the L5 band of GPS or the L6 band of QZSS as satellite signals. Each of the antenna elements 10, 20 is a two-feed antenna by the feed pins P1, P2, and has a larger bandwidth than a single-feed antenna.

As shown in FIG. 4, the Wilkinson divider 31 is, for example, a Wilkinson divider described in Japanese Patent No. 5644702 and based on a distribution constant. The Wilkinson divider 31 includes a dividing circuit C1 and a phase shift circuit C2. The dividing circuit C1 is the Wilkinson's dividing circuit. A pin connector 315B formed in the hole of the substrate body 301 is soldered and electrically connected to the feed pin P1 inserted therein. The pin connector 315A formed in the hole of the substrate body 301 is soldered and electrically connected to the feed pin P2 inserted therein.

The dividing circuit C1 includes a connector (coupling unit) 311, path sections 312A, 312B, and a resistor 313. The connector 311 is a connector electrically connected to the amplifier 32. Each of the path sections 312A, 312B is a path pattern from the connector 311 to the resistor 313. The resistor 313 is arranged between two output terminals of the path sections 312A, 312B (two input terminals of the path sections 314A, 314B).

The phase shift circuit C2 includes the path sections 314A, 314B and the pin connectors 315A, 315B. The path section 314A is a path pattern from the resistor 313 to the pin connector 315A. The path section 314B is a path pattern from the resistor 313 to the pin connector 315B. The pin connector 315A is a connector which the feed pin P1 is inserted into and electrically connected to. The pin connector 315B is a connector which the feed pin P2 is inserted into and electrically connected to.

That is, in the Wilkinson divider 31, the path between the amplifier 32 and the feed pin P1, P2 is divided into the following paths R1 and R2. The path R1 is from the connector 311, the path section 312A, (the resistor 313), the path section 314A, and the pin connector 315A. The path R2 is from the connector 311, the path section 312B, (the resistor 313), the path section 314B, and the pin connector 315B. When the wavelength of the radio signal received by the antenna elements 10, 20 is λ, the path length of the path section 312A is set to λ/4. The path length of the path section 312B is set to λ/4. The wavelength λ corresponds to, for example, the center frequency of the frequency bands (the L1 band of GPS, L2 band of GPS, and the L5 band of GPS or L6 band of QZSS) that the antenna elements 10, 20 deal with.

The pin connector 315A is arranged near the resistor 313. Therefore, when compared with the path length of the path section 314B, the path length of the path section 314A can be regarded as zero. The path length of the path section 314B is longer than that of the path section 314A by λ/4. This difference in length of λ/4 corresponds to a difference of 90 degrees in phase. That is, the signal having passed through the path R1 and the signal having passed through the path R2 are out of phase by 90 degrees.

The line width of the connector 311 is set such that the impedance of the connector 311 is 50Ω, for example. The impedance of each of the path sections 312A, 312B is adjusted to 100Ω from the connector 311 side, and 50Ω from the feed pin side. Specifically, the line width of each of the path sections 312A, 312B is set such that the impedance is about 71Ω (70.7Ω). The line widths of the path sections 314A, 314B are set such that the impedance of each of them is 50Ω, for example. Each of the pin connectors 315A, 315B has an impedance of 50Ω.

The resistor 313 is provided to improve the isolation of the path R1 and the path R2 from each other. The corner(s) of the paths R1, R2 (the portions where the paths are bent at right angles) is chamfered at 45 degrees, considering that current flowing the paths R1, R2 passes through an inner portion at a corner so that the flowing length becomes short. Therefore, since an outer portion in the width direction of the paths R1, R2 is not necessary, the paths R1, R2 are chamfered so that the capacity component can be prevented from increasing.

The electric signal for feeding is input to the connector 311 to be distributed into two paths, passes through the path sections 312A, 312B as the paths R1, R2, and reaches the resistor 313. In the path R1, the electric signal having passed the resistor 313 passes through the path section 314A and is input to the pin connector 315A. In the path R2, the electric signal having passed the resistor 313 passes through the path section 314B and is input to the pin connector 315B. The phase of the electric signal at the pin connector 315A in the path R2 is delayed by 90 degrees in phase from the electric signal at the pin connector 315B in the path R1. Accordingly, a circularly polarized radio signal is emitted from the emitting electrode 22.

The transmission characteristics of the antenna (the characteristics of inputting an electrical signal to the antenna) are equivalent to the reception characteristics of the antenna (the characteristics of outputting an electrical signal from the antenna). Therefore, the Wilkinson divider 31 can be applied to the antenna device 1 (antenna elements 10, 20) that receives a circularly polarized GNSS signal. The Wilkinson divider 31 in FIG. 5 has a path section 31R1 and a path section 31R2 respectively corresponding to the path R1 and the path R2 in FIG. 4. That is, when the phase of the electrical signal output from the path section 31R1 is regarded not to be shifted, the phase of the electrical signal output from the path section 31R2 is shifted because of the path section 314A.

The amplifier 32 is a first amplifier such as an LNA that amplifies the signal output from the connector 311 of the Wilkinson divider 31. The amplifier 33 is a second amplifier such as an LNA that amplifies the signal output by the amplifier 32. The Wilkinson divider 34 is a Wilkinson divider based on a lumped constant, and distributes one output path of the amplifier 33 into two paths.

The BPF 35A is a filter that transmits (allows passage of) signals of frequencies in the L1 band and the L2 band of GPS from the signals on one of the paths output by the Wilkinson divider 34. The BPF 35A includes, for example, a Double Hump SAW (Surface Acoustic Wave) Filter. The amplifier 36A is a third amplifier such as an LNA that amplifies the signal output from the BPF 35A. The attenuator 37A is an attenuator that attenuates the signal output by the amplifier 36A. The attenuator 37A appropriately attenuates and adjusts the gain of the signal having been amplified by the amplifier 36A, and also adjusts impedances.

The BPF 35B is a filter that transmits (allows passage of) signals having frequencies in the L5 band of GPS or the L6 band of QZSS from the signals on one of the paths output by the Wilkinson divider 34. The amplifier 36B is a third amplifier such as an LNA that amplifies the signal output by the BPF 35A. The attenuator 37B is an attenuator that attenuates the signal having been output by the amplifier 36B. The attenuator 37B appropriately attenuates and adjusts the gain of the signal having been unnecessarily amplified by the amplifier 36B, and also adjusts the impedance.

The Wilkinson divider 38 is a Wilkinson divider based on a lumped constant, and couples the two output paths, one from the attenuator 37A and the other from the attenuator 37B, into one path. In general, while a Wilkinson divider based on a distribution constant requires less chip components, a Wilkinson divider based on a lumped constant occupies less area on the substrate. For example, the Wilkinson divider 31 may be a Wilkinson divider based on a lumped constant, and the Wilkinson dividers 34, 38 may be Wilkinson dividers each based on a distribution constant.

The coaxial cable connector 39 is a connector to which the coaxial cable 50 is electrically connected. The coaxial cable connector 39 has an inner conductor connector 391 and an outer conductor connector 392. The inner conductor connector 391 is electrically connected to the output terminal of the Wilkinson divider 38 and is also electrically connected to the inner conductor 51 of the coaxial cable 50. The outer conductor connector 392 is electrically connected to the outer conductor 52 of the coaxial cable 50 and is also electrically connected to the ground pattern G1 on the substrate 301. The outer conductor connector 392 is electrically connected to the outer conductor 52 of the coaxial cable 50 and is also electrically connected to the ground pattern G1 on the substrate 301.

As described above, according to the present embodiment, the antenna device 1 has the antenna unit A1 that receives respective radio waves of three first frequency bands (the L1 band of GPS, the L2 band of GPS, and the L5 band of GPS or the L6 band of QZSS) and then outputs received signals, and the BPF 35A through which, out of the received signals of the three first frequency bands, received signals of two second frequency bands (the L1 band of GPS and the L2 band of GPS) passes. Therefore, one band-pass filter and amplifier is provided for a plurality of (two) frequency bands so that the circuit configuration can be simplified for dealing with the received signals of a plurality of (three) frequency bands.

Furthermore, positioning accuracy can be improved by the antenna device 1 that uses frequency bands of the L1 band, L2 band, and L5 band of GPS in combination, compared with the conventional GPS (GNSS) antenna that uses the L1 band alone. Furthermore, centimeter-level positioning is possible by the antenna device 1 that uses the L1 band of GPS, L2 band of GPS, and the L6 band of QZSS in combination.

Furthermore, the antenna device 1 can be used in a motor vehicle as a moving object in an advanced driver-assistance system (ADAS). Furthermore, the antenna device 1 can be used in an agricultural device to realize automatic operation of the agricultural device. Furthermore, the antenna device 1 can be used in an IT (Information Technology) construction, to realize construction such as unmanned cutting.

Furthermore, the antenna device 1 has the BPF 35B that transmits, out of the received signals, a received signal of one third frequency band (L5 band of GPS or the L6 band of QZSS), which is out of the three first frequency bands and which is not the second frequency bands. Therefore, frequency bands other than the first frequency bands can be reliably filtered.

Furthermore, the antenna unit A1 has stacked antenna elements 10, 20. The antenna elements 10, 20 each receives a radio wave(s) of at least one of the three first frequency bands (the antenna element 10 receives the L1 band of GPS, and the antenna element 20 receives the L2 band of GPS and one of the L5 band of GPS and the L6 band of QZSS) and then outputs received signals. Therefore, the area of the antenna unit A1 can be small.

Furthermore, the upper antenna element 10 among the antenna elements 10, 20 is fed by the feed pins P1, P2 that pass through the antenna elements 10, 20. The antenna device 1 includes a Wilkinson divider 31 as a phase adjuster that adjusts the phase of the received signals output from the feed pins P1, P2. Out of the received signals output from the Wilkinson divider 31, received signals of two second frequency bands passes through the BPF 35A. When the antenna elements 10, 20 are such two-feed patch antennas, the bandwidth of the frequency band to be dealt with can be expanded. In particular, the antenna element 20 can reliably receive radio waves of two second frequency bands (L2 band of GPS and one of L5 band and the L6 band of QZSS).

Furthermore, the Wilkinson divider 31 includes the dividing circuit C1 and the phase shift circuit C2. The dividing circuit C1 includes the connector 311 that is connected to the input terminal of feeding, the path sections 312A, 312B that are paths divided into two from the connector 311 and each have a path length of $\lambda/4$, and the resistor 313 that is connected to the output terminals of the path sections 312A, 312B. The phase shift circuit C2 includes the path section 314A and the path section 314B. The path section 314A is a path from the resistor 313 to the pin connector 315A connected to the feed pin P2 and has an input terminal near the pin connector 315A. The path section 314B is a path from the resistor 313 to the pin connector 315B connected to the feed pin P1 and has a path length longer than path section 314A by $\lambda/4$.

Therefore, a good axial ratio can be obtained from frequency ranges of a wide bandwidth such that the three first frequency bands (the L1 band of GPS, the L2 band of GPS, and the L5 band of GPS or the L6 band of QZSS) can be used in combination, isolation between the paths R1, R2 can be improved from the input terminal to the pin connectors 315A, 315B, and the area of the Wilkinson divider 31 can be small. As the impedances of the paths R1, R2 are balanced, impedance matching can be easily made within a wide bandwidth. The reduction of the Wilkinson divider 31 leads to reduction of the substrate 30 and then reduction of the antenna device 1 in size.

The description in the above embodiment is an example of the antenna device according to the present invention, and the present invention is not limited to this.

In the above-described embodiment, the antenna device 1 deals with the frequency bands including the L1 band of GPS, the L2 band of GPS, and the L5 band of GPS or the L6 band of QZSS, but the present invention is not limited to this. The antenna device 1 may deal with three or more other frequency bands of one or more communication standards. It may deal with four frequency bands of two communication standards, for example, the L1 band of GPS, the L1 band of GLONASS, the L2 band of GPS, and the L5 band of GPS. It may alternatively deal with four frequency bands of three communication standards, for example, the L1 band of GPS, the L1 band of GLONASS, the L2 band of GPS, and the L6 band of QZSS.

Furthermore, in the above-described embodiment, the substrate 30 of the antenna device 1 includes the BPF 35A that transmits signals of two frequency bands (L1 band and L2 band of GPS) and the BPF 35B that transmits a signal of one frequency band (L5 band or L6 band of GPS), but the present invention is not limited to this. For example, the substrate 30 may include a Triple Humped SAW Filter, which is a BPF that transmits signals of three frequency bands (L1 band of GPS, L2 band of GPS, and L5 or L6 band of GPS). According to such a configuration, the substrate 30 may not have the Wilkinson dividers 34, 38 and the amplifier 36B and the attenuator 37B in one of the paths, the area of the of the substrate 30 can be reduced, the number of parts can be reduced, and the circuit configuration can be simplified for dealing with the received signals of a plurality of (three) frequency bands.

Figure 6:
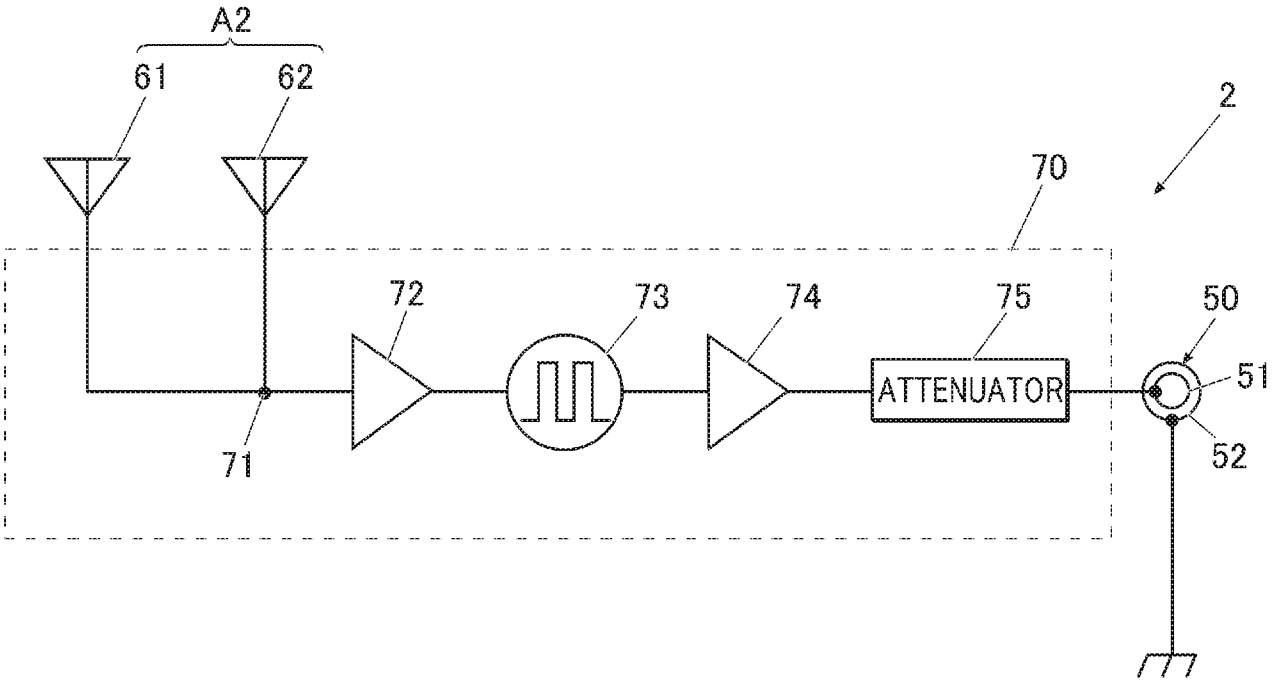
FIG. 6 is a circuit diagram of a second antenna device.

Furthermore, in the above-described embodiment, the antenna device 1 deals with three frequency bands, however, it may be an antenna device that deals with two frequency bands or four or more frequency bands. For example, it may be an antenna device 2 having a circuit configuration in FIG. 6. The antenna device 2 includes an antenna unit A2, a substrate 70, and a coaxial cable 50. The antenna unit A2 is a patch antenna having antenna elements 61, 62.

The antenna element 61 is a patch antenna that deals with the L1 band of GPS, for example, is a single-feed antenna element including a base, an emitting electrode, and a ground electrode, and fed by a first feed pin. The antenna element 62 is a patch antenna that deals with the L2 band of GPS, for example, and is a single-feed antenna element including a base, an emitting electrode, and a ground electrode and fed by a second feed pin. The antenna device 2 has the substrate 70, the antenna element 62, and the antenna element 61 stacked in this order from bottom to top. Therefore, the first feed pin is electrically connected to the emitting electrode of the antenna element 61 and penetrates a hole in the antenna elements 61, 62. The second feed pin is electrically connected to the emitting electrode of the antenna element 62 and penetrates a hole in the antenna element 62.

The substrate 70 includes a substrate body on which a Wilkinson divider (Wilkinson coupler) 71, an amplifier 72, a BPF 73, an amplifier 74, and an attenuator 75 are provided, and is connected to the coaxial cable 50. The Wilkinson divider 71 is, for example, a Wilkinson divider based on a lumped parameter, and couples the two output paths, one from the antenna element 61 and the other from the antenna element 62, into one path. The amplifier 72 amplifies the received signal output from the Wilkinson divider 71. The BPF 73 is a filter that transmits (allows passage of), out of the received signals amplified by the amplifier 72, signals of the L1 band and L2 band of GPS. The amplifier 74 amplifies the received signals output from the BPF 73. The attenuator 75 attenuates the received signals amplified by the amplifier 74 and outputs them to the inner conductor 51 of the coaxial cable 50.

In such a configuration, the one BPF 73 also transmits the received signals of the two frequency bands (the L1 band and L2 band of GPS). Therefore, one band-pass filter and amplifier is provided for a plurality of (two) frequency bands, so that the circuit configuration can be simplified for dealing with the received signals of a plurality of (two) frequency bands.

Furthermore, the detailed configuration and the detailed operation of the antenna device in the above embodiment can be appropriately changed without departing from the spirit of the present invention.

The entire disclosure of Japanese Patent Application No. 2019-015782 filed on Jan. 31, 2019 is incorporated herein by reference in its entirety.

What is claimed is:

1. An antenna device comprising:

an antenna unit that receives radio waves of a plurality of first frequency bands and outputs received signals, the antenna unit having a plurality of stacked antenna elements;

a first band pass filter that transmits, from among the received signals that are output from the antenna unit, received signals of at least two second frequency bands from among the first frequency bands;

a first feed pin and a second feed pin that feed an upper antenna element from among the antenna elements and that penetrate the antenna elements; and a phase adjuster that outputs received signals that are output from each of the first feed pin and the second feed pin after adjusting phases of the received signals, wherein:

each of the antenna elements receives a radio wave of at least one of the first frequency bands and outputs a received signal, and the first band pass filter transmits, from among the received signals that are output from the phase adjuster, the received signals of the at least two second frequency bands.

2. The antenna device according to claim 1, further comprising a second band pass filter that transmits, from among the received signals that are output from the antenna unit, a received signal of one third frequency band from among the first frequency bands, the third frequency band being different from the second frequency bands.

3. The antenna device according to claim 1, wherein the phase adjuster includes:

a dividing circuit including:

a connector that is connected to an input terminal of feeding;

a first path section and a second path section that are paths divided into two from the connector and that each have a path length of $\lambda/4$; and a resistor that is connected to an output terminal of the first path section and an output terminal of the second path section, and a phase shift circuit including:

a third path section that is a path from the resistor to a first pin connector connected to the first feed pin and whose input terminal is near the first pin connector; and a fourth path section that is a path from the resistor to a second pin connector connected to the second feed pin and that has a path length longer than a path length of the third path section by $\lambda/4$, and wherein $\lambda$ is a wavelength corresponding to a center frequency of the first frequency bands.

* * * * *